United States Patent [19]

Racioppi

[11] Patent Number: 4,890,348

[45] Date of Patent: Jan. 2, 1990

[54] RAZOR CLEANING DEVICE

[76] Inventor: Richard J. Racioppi, R.R. 1, Box 195, Mohamet, Ill. 61853

[21] Appl. No.: 240,474

[22] Filed: Sep. 6, 1988

Related U.S. Application Data

[63] Continuation of Ser. No. 51,937, May 19, 1987, abandoned.

[51] Int. Cl.[4] ..... A46B 9/02

[52] U.S. Cl. ..... 15/160; 15/218; 15/DIG. 5

[58] Field of Search ..... 15/159 A, 160, 164, 15/167.1, 167.2, 167.3, DIG. 5, 218, 146

[56] References Cited

U.S. PATENT DOCUMENTS

| | | | |
|---|---|---|---|
| 1,225,969 | 5/1917 | Kennedy | 15/218 |
| 1,329,694 | 2/1920 | Beck . | |
| 2,128,011 | 8/1938 | Morgan . | |
| 2,591,331 | 4/1952 | Baumbach . | |
| 2,768,402 | 10/1956 | Back . | |
| 2,772,430 | 12/1956 | Morritt | 15/164 |
| 2,837,755 | 6/1958 | Jones | 15/106 |
| 3,027,583 | 4/1962 | Bain . | |
| 3,503,088 | 3/1970 | Anthone . | |
| 3,631,560 | 1/1972 | Atkins . | |
| 4,453,285 | 6/1984 | van Rosberg . | |

FOREIGN PATENT DOCUMENTS

| | | | |
|---|---|---|---|
| 253922 | 11/1948 | Fed. Rep. of Germany | 15/160 |
| 2240460 | 3/1974 | Fed. Rep. of Germany | 15/167.3 |
| 225048 | 11/1924 | United Kingdom | 15/167.3 |
| 678406 | 9/1952 | United Kingdom | 15/167.3 |

*Primary Examiner*—Philip R. Coe
*Assistant Examiner*—K. O'Leary
*Attorney, Agent, or Firm*—Seed and Berry

[57] ABSTRACT

A razor cleaning device has a suction cup base which supports a stem. The end of the stem supports a cleaning head which has a plurality of bristles. The bristles are disposed in an appropriate angle so that a blade positioned against the bristles in a natural cleaning motion remains substantially parallel to the bristles. A wiping plane defined by free ends of the bristles can be disposed at an actue angle with respect to the bristle direction to apply even pressure and effectively clean twin edges of twin blade razors.

13 Claims, 1 Drawing Sheet

FIG. 1
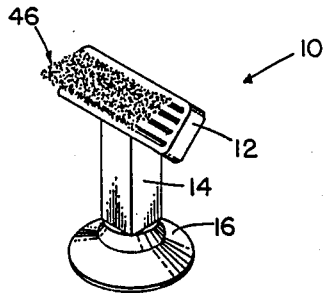
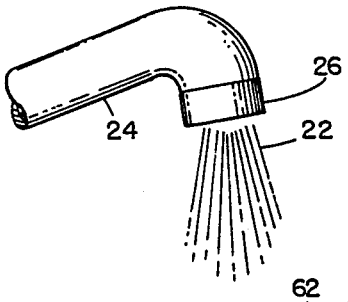
FIG. 3
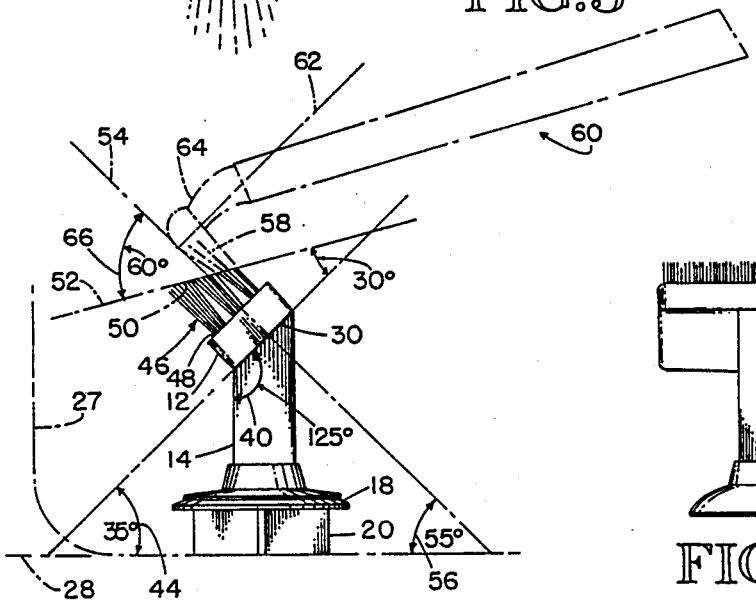
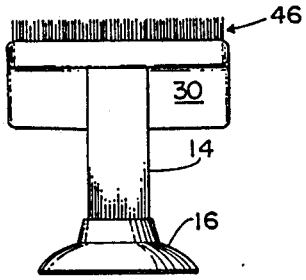
FIG. 2

RAZOR CLEANING DEVICE

This application is a continuation of U.S. patent application Ser. No. 051,937, filed May 19, 1987, now abandoned under C.F.R. §1.62.

TECHNICAL FIELD

The invention relates to cleaning brushes which are removably supportable in a wash basin, sink, bathtub or the like. More specifically, the invention relates to cleaning brushes for razors.

BACKGROUND ART

Straight edge razors are characterized by an elongated blade having a single edge with a handle pivotally attached to the blade. The handle and blade generally define a single plane. As is well-known to those who have used them, straight edge razors require substantial skill in order to prevent being cut. A straight edge razor, however, is relatively easy to clean because of the exposed blade.

The use of straight edge razors has been largely supplanted by use of the modern safety razor. Safety razors are characterized by a single blade having two cutting edges. The blade is received in a razor head which has safety guards adjustably positionable in a spaced relation from the blade edges. A handle is attached to the head. The handle is generally perpendicular to the plane defined by the blade.

Safety razors require relatively little skill to use safely, but are somehat more difficult to clean than straight edge razors because of the close proximity of the face guards with the blade edges. It is well known that by running the safety razor under a flow of hot water, beard or leg shavings and shaving cream can be easily dislodged from the gap between the blade edge and the face guards.

The advent of the modern twin blade razor has significantly increased the difficulty associated with cleaning shavings and shaving cream from a gap between the adjacent blade edges. Razors of this type are sold under the trademarks TWIN-TRAC, ATRA, TRAC TWO, and ULTREX. These blades are characterized by two short, parallel, closely spaced blades which have two elongated edges. The edges of the two adjacent blades are staggered so that the second blade will cut a hair shaft as the first blade extends the hair shaft from the follicle. Shavings and shaving cream trapped between the blades are difficult to dislodge. It is well known to those who use these blades that merely running the razor head under hot water may not be sufficient to thoroughly clean the blades. Thus, users typically tap the razor head against the side of the sink or wash basin to dislodge cuttings between the blades while alternately running the razor head under a steady flow of water.

Manufacturers have recognized the problem associated with cleaning the area between the adjacent blade edges. One manufacturer has provided a thin sheet of flexible plastic material which is extendible into the gap between the blades and retractable therefrom upon depression and release of a button external to the razor head. These blades are considerably more expensive than twin blades without the self-cleaning feature.

DISCLOSURE OF THE INVENTION

It is an object of the present invention to provide a razor cleaning device which facilitates cleaning razors of the type having twin blades.

It is also an object of the present invention to achieve the above object with a device which is also suitable for cleaning double-edged, single blade safety razors.

It is yet another object of the present invention to achieve the above objects with a device which does not interfere with the normal operation of a wash basin, sink, tub or the like.

The invention achieves these objects, and other objects and advantages which will become apparent from the description which follows, by utilizing a cleaning head which has a plurality of substantially straight bristles. The bristles are generally aligned along a bristle direction. The cleaning head is supported so that the bristle direction is substantially parallel to the position which a razor blade naturally assumes when the user brushes the razor head against the free ends of the bristles.

In the preferred embodiment, the cleaning head is removably attachable to the pop-up stopper of a sink or bathtub by a section cup. The bristles are cut, or the free ends of the bristles otherwise disposed, so as to define a wiping plane which forms an acute angle of approximately 60° with respect to the bristle direction. This disposition of the wiping plane causes both edges of a twin blade razor to be equally engaged by the free ends of the bristles when the user wipes the razor head across the bristle free ends in a natural motion.

The device is also usable with conventional single blade, double edge safety razors.

BRIEF DESCRIPTION OF THE DRAWINGS

FIG. 1 is an isometric view of a razor cleaning device of the present invention.

FIG. 2 is a rear elevational view of the razor cleaning device shown in FIG. 1.

FIG. 3 is a side elevational view of the razor cleaning device removably mounted on the pop-up stopper in a sink beneath the flow of running water.

BEST MODE FOR CARRYING OUT THE INVENTION

A razor cleaning device, in accordance with the present invention is generally indicated at reference numeral 10 in the Figures. The device is particularly useful for cleaning twin blade edges in twin blade razors and single edges of conventional double edged safety razors. As used herein, the terms "safety type razor," "twin blade razor," or "safety razor," identify a class of razors which are distinguishable from straight edge razors.

A device 10 has a cleaning head 12 which is supported by an elongated stem 14. The stem has a suction cup base 16 which permits the device 10 to be removably supported on the crown 18 of a pop-up drain stopper 20 as shown in FIG. 3. The stem is substantially straight so that the cleaning head is positioned beneath a flow of water 22 which is directed by a faucet 24. Faucets in sinks, tubs and the like generally have a nozzle 26 which directs the flow of water 22 over the pop-up drain stopper 20. As shown in FIGS. 2 and 3, the suction cup base 16 generally positions the elongated stem 14 in a perpendicular relationship with the bottom of the basin 27, generally represented by dashed line 28.

The cleaning head 12 is generally rectangular, having a substantially planar back surface 30 which is connected to stem 14. The end of the stem opposite the suction cup base forms an angle 40 of approximately 125° with the stem 14. This places the back surface 30 of the cleaning head 12 at an acute angle 44 of approximately 35° with respect to the horizontal (a horizontal reference being defined by the dashed line 28 at the bottom of the basin 28).

The cleaning head 12 has a plurality of bristles, generally indicated at reference numeral 46. The bristles have fixed ends 48 which are attached to the cleaning head 12 and free ends 50 which define a wiping plane indicated by dashed line 52. The bristles are generally oriented in a bristle direction indicated by dashed line 54. The bristles are generally perpendicular to the back surface 30 of the cleaning head 12.

With reference to FIG. 3, it is seen that by connecting the back surface of the cleaning head 12 with the stem 14 at an acute angle 44 of 35°, the bristle direction 54 is generally at a complementary angle 56 of approximately 55° with respect to the horizontal surface 28. It has been found that this angle generally corresponds to the angle which a blade or blades 58 received in a conventional, single blade safety or twin blade razor 60 assume when the blades are wiped against the free ends 50 of the bristles 46 in a natural wiping motion. It has been found that this orientation of the blades 58 is relatively constant whether the device 10 is positioned on the pop-stopper of a sink or a bathtub. It is highly preferred that the bristles remain generally parallel to the blades 58 when the blades are positioned against the wiping plane 52 defined by the free ends of the bristles. Any similar structure for generally positioning the bristles in parallel relationship is suitable, although the preferred structure is shown.

It is of particular importance with razors of the twin blade type that an even cleaning pressure be distributed over the twin blades. It is known that the blades of twin blade razors are generally parallel to one another and have staggered edges which are closely spaced. The blades 58 of a twin bladed razor are generally perpendicular to an axis 62 defined by a portion of the razor handle 64. On many twin blade razors, the edges of the blades are offset at an angle of approximately 30° to the axis 62. Furthermore, it has been found that the natural position of the axis 62 defined by the portion 64 of the razor handle is approximately parallel to the acute angle 44 formed by the back surface 30 of the cleaning head 12 with the horizontal surface 28. Thus, the free ends 50 of the bristles 46 are positioned so that the wiping plane 52 defined by the free ends is at a corresponding angle of 30° with respect to the back surface 30 of the cleaning head 12. This positions the wiping plane 52 at a complementary angle 66 of approximately 60° with the bristle direction 54. It has been found that this orientation of the wiping plane causes an even distribution of pressure to be applied against each of the twin blades when the blades are wiped against the free ends of the bristles in a natural motion.

To achieve the angularly disposed relationship of the wiping plane 52 with the back surface 30 of the cleaning head 12 as described above, the bristles 46 vary in exposed length from approximately 3/16" to approximately ⅜".

In the preferred embodiment shown in the drawings, the stem 14 and cleaning head 12 are molded from an acrylic material. The stem 14 has a threaded bore (not shown) for accepting a correspondingly threaded screw. The suction cup base 16 includes 8/32 by ¼" machine screw molded into a rubber suction cup measuring 1" in diameter. The bore is tapped for 8/32 threads which accommodate the screw molded into the suction cup.

The end of the stem 14 opposite the base is cut at a 35° angle to form the 125° angle 40 with the back surface 30 and to provide a mounting surface for the cleaning head 12. The stem has a maximum length of approximately 1", and a width and depth of approximately ⅜". The maximum length of the stem can vary between approximately 1" to approximately 6".

The cleaning head 12 measures 1½" by ½" by ¼" and is also constructed of an acrylic material. The bristles 46 generally comprise 60 groups of plastic bristles in four rows and 15 columns. The overall length of the longest bristles is approximately ½" with ⅛" of each bristle molded into the cleaning head. Each group of bristles is spaced approximately 3/32" apart from center to center. The groups start 1/16" from the perimeter of the cleaning head. Each group of bristles consists of approximately 38 individual bristles.

The specific dimensions and angles referenced above may be altered without departing from the spirit of the invention. Primarily, the angular relation of the bristle direction 54 with the horizontal and the angular relationship of the wiping plane 52 with the bristle direction 54 is important. It is also desirable that the stem be sufficiently short so that the device can remain in place on the pop-up stopper 20 without interfering with normal use of the faucet 24. It has been found the maximum cleaning efficiency is achieved when a steady flow of water 22 falls on the bristles 46. A high pressure flow of water is not required.

The invention permits the use of substantially less hot water to clean even the space between edges of twin blade razors which heretofore required that the user tap the razor head against the sides of the sink or other wash basin. The device 10 is small and quite easily transported from one basin to another. Thus, travelers will find the device particularly useful, especially in areas where self-cleaning blades cannot be purchased.

Various other embodiments of the invention are also contemplated. Therefore, the invention is not to be limited by the above description, but is to be determined in scope by the claims which follow.

I claim:

1. A razor cleaning device supportable on a support surface within a wash basin, sink, bathtub or the like which have a faucet and a drain stopper, to facilitate cleaning razors of the type having two parallel blades having adjacent, staggered edges, comprising:

a cleaning head having a plurality of substantially straight bristles substantially aligned in a bristle dirction, each bristle having a fixed end connected to the cleaning head and a free end, the free ends of the bristles being positioned to substantially define a single continuous wiping plane which tapers downwardly relative to the support surface at a first acute angle with respect to the support surface and a second acute angle with respect to the bristle direction, said first acute angle being less than said second acute angle; and support means for securing the cleaning head on a support surface and for orienting the cleaning head so that the bristle direction defines an acute bristle direction angle of approximately 55° with respect to the support surface, the first acute angle of the wiping plane with the support surface being less than 35° and whereby a user can naturally and simultaneously position the razor blades substantially parallel to the bristle direction and press edges of the blades equally against the bristle free ends when wiping the razor against the bristles.

2. The razor cleaning device of claim 1 wherein the second acute is approximately 60°.

3. The razor cleaning device of claim 1 wherein the support means includes an elongated stem having first and second ends, the first end connected to a suction cup and the second end connected to the cleaning head.

4. The razor cleaning device of claim 3 wherein the stem has a length of approximately one inch to six inches, so that the cleaning head may fit conveniently beneath the faucet in the sink when the suction cup is engaged with the stopper in the sink.

5. The razor cleaning device of claim 4 wherein the bristles have an exposed length which tapers from between approximately 3/16" to ⅜".

6. A razor cleaning device supportable on a pop-up stopper in a sink, bathtub or the like to facilitate cleaning razors of the type having two parallel blades having adjacent staggered edges, comprising:

a suction cup base engageable with a support surface for conveniently positioning the device beneath a water flow;

an elongated stem having a first end and a second end, the first end connected to the suction cup so that the stem is generally perpendicular to the support surface; and a cleaning head carried by the second end of the stem and being oriented at an acute angle with respect to the support surface, the cleaning head having a plurality of cleaning bristles having fixed ends connected thereto and free ends positioned to define a single continuous wiping plane which is sloped at a first acute angle with respect to the support surface, the bristles defining a bristle direction generally perpendicular to the cleaning head and at a second acute angle with respect to the support surface, and said first acute angle being less than said second acute angle whereby a user cleaning a razor will naturally position the razor blades in a parallel relationship to the cleaning bristles and press edges of the blades equally against the bristle free ends when the blade is wiped against the bristles.

7. The razor cleaning device of claim 6 wherein the first acute angle is less than approximately 35° and the second acute angle is approximately 55° with respect to the support surface.

8. The razor cleaning device of claim 6 wherein a complementary angle of approximately 60° is formed between the wiping plane and the bristle direction.

9. The razor cleaning device of claim 8 wherein the bristles have varying lengths, the shortest bristles having lengths of approximately 3/16" and the longest bristles having lengths of approximately ⅜".

10. A razor cleaning device for use with and supportable on a stopper which is disposed in vertically spaced relationship from a faucet within a wash basin, sink, bathtub or the like, to facilitate cleaning razors of the type having two parallel blades having adjacent, staggered edges, comprising:

a stem having first and second ends; a cleaning head carried by the stem adjacent the first end thereof;

support means extending from said second end of the stem for supporting the device on the stopper beneath the faucet;

a plurality of substantially parallel bristles mounted to the cleaning head and having free ends, the bristles generally extending in a bristle direction; the free ends of the bristles forming a single continuous sloped wiping surface which is oriented at a first acute angle with respect to the stopper;

the bristle direction oriented at a second acute angle with respect to the stopper the first acute angle being less than the second acute angle whereby a user will naturally position the blades of a conventional twin blade razor substantially parallel to the bristle direction and so that the bristle free ends press equally against each edge of a conventional twin blade razor to facilitate removal of foreign matter from a gap between the twin blades.

11. The razor cleaning device of claim 10 wherein the said second acute angle being substantially equal to 55° and said first acute angle being less than approximately 35°.

12. A razor cleaning device supportable on a pop-up stopper in a sink, bathtub or the like to facilitate cleaning razors of the type having two parallel blades having adjacent staggered edges, comprising:

support means for securing the device to a support surface for conveniently positioning the device beneath a water flow;

an elongated stem having a first end and a second end, the first end connected to the support means so that the stem is generally perpendicular to the support surface; and a cleaning head carried by the second end of the stem and being oriented at an acute angle with respect to the support surface, the cleaning head having a plurality of cleaning bristles having fixed ends connected thereto and free ends positioned to define a single continuous wiping plane which is sloped at a first acute angle with respect to the support surface, the bristles defining a bristle direction generally perpendicular to the cleaning head and at a second acute angle with respect to the support surface, and said first acute angle being less than said second acute angle whereby a user cleaning a razor will naturally position the razor blades in a parallel relationship to the cleaning bristles and press the edges of the blades equally against the bristle free ends when the blade is wiped against the bristles.

13. The razor cleaning device of claim 12 in which said support means is a suction cup and said stem has a length of approximately one inch to six inches.

* * * * *